US005902192A

United States Patent [19]

Kashiwagi et al.

[11] Patent Number: 5,902,192

[45] Date of Patent: May 11, 1999

[54] GOLF BALL

[75] Inventors: Shunichi Kashiwagi; Yasushi Ichikawa; Rinya Takesue, all of Chichibu, Japan

[73] Assignee: Bridgestone Sports Co., Ltd., Tokyo, Japan

[21] Appl. No.: 08/998,055

[22] Filed: Dec. 24, 1997

[30] Foreign Application Priority Data

Dec. 26, 1996 [JP] Japan ..... 8-357275

[51] Int. Cl.[6] ..... A63B 37/06

[52] U.S. Cl. ..... 473/372; 473/359

[58] Field of Search ..... 473/359, 360, 473/372, 373, 385

[56] References Cited

U.S. PATENT DOCUMENTS 5,374,677 12/1994 Nishio et al. ..... 524/451

5,779,561 7/1998 Sullivan et al. ..... 473/373

*Primary Examiner*—George J. Marlo

*Attorney, Agent, or Firm*—Sughrue, Mion, Zinn, Macpeak & Seas, PLLC

[57] ABSTRACT

A golf ball is provided having a solid core which is formed of a core stock comprising a thermoplastic resin or elastomer and fibrous aluminum borate whiskers. The ball is improved in restitution. Particularly, the one-piece golf ball is durably resistant to damages by iron shots.

6 Claims, 1 Drawing Sheet

ONE-PIECE GOLF BALL CONTAINING FIBROUS ALUMINUM BORATE WHISKERS, PREFERABLY HAVING A MEAN LENGTH OF 5 TO 50 μm AND A MEAN DIAMETER OF 0.1 TO 0.2 μm

GOLF BALL

BACKGROUND OF THE INVENTION

1. Field of the Invention

This invention relates to a golf ball having improved restitution and more particularly, a one-piece golf ball having improved durability in terms of cut resistance and scuff resistance upon iron shots 2. Prior Art Golf balls known in the art include one-piece golf balls, solid golf balls, and wound golf balls. The one-piece golf balls are generally prepared by heat curing a rubber composition comprising polybutadiene, methacrylic acid, zinc oxide and peroxide. The solid golf balls including two- and three-piece golf balls are generally prepared by heat curing a rubber composition comprising polybutadiene, zinc acrylate and peroxide to form a solid core and molding a cover around the core with an intermediate layer optionally interposed therebetween. The wound golf balls are generally prepared by molding a cover around a wound core.

One-piece golf balls and solid cores are often formed of rubber compositions as mentioned above It is also proposed to use thermoplastic elastomers such as thermo-plastic polyester elastomers in the manufacture of one-piece golf balls and solid cores since these elastomers are relatively easy to mold and durable.

The one-piece golf balls and solid cores of thermoplastic elastomers, however, are prone to deformation by repetitive shots and leave room for improvement in durability. Particularly when such a one-piece golf ball is hit with an iron, the ball is readily indented by the club face and scuffed thereby to become fluffy or scraped on the surface. Sometimes cracks occur and dimples can be scraped off. Thus the one-piece golf ball needs further improvement in durability in terms of scuff resistance and cut resistance.

SUMMARY OF THE INVENTION

Therefore, an object of the present invention is to provide a novel and improved golf ball having improved restitution and especially, a one-piece golf ball which is durably cut resistant and scuff resistant and leaves minimal deformation after shots.

The invention is directed to a golf ball comprising a solid core which is formed of a core stock comprising a thermoplastic resin or elastomer as a main component. The inventors have found that by blending fibrous aluminum borate whiskers in the core stock, there is obtained a golf ball which is not only good in rebound, but also fully durable when manufactured as a one-piece golf ball. That is, the one-piece piece golf ball is resistant to indentation by the club face upon iron shots, prevents the occurrence of scuffs, scrapes and cracks, and leaves minimal deformation after shots.

Of the components known in the prior art as imparting durability to the solid cores some are less reinforcing because of the geometrical and modulus factors of themselves, some are detrimental to restitution because they place a too much stress on durability and scuff resistance, and some allow the ball to remain substantially deformed after shots. Fibrous aluminum borate whiskers are very fine white needle crystals as compared with glass fibers, have high strength and high tensile modulus and are chemically neutral. When fibrous aluminum borate whiskers are blended with a thermoplastic resin or elastomer, the whiskers are uniformly dispersed in the resin or elastomer so that the core formed therefrom is fully resilient. Particularly when a one-piece golf ball is formed therefrom, it is durably resistant to iron shots and leaves minimal deformation after shots. The present invention is predicated on this finding.

According to the invention, there is provided a golf ball comprising a solid core which is formed of a core stock comprising a thermoplastic resin or elastomer and fibrous aluminum borate whiskers.

DETAILED DESCRIPTION OF THE INVENTION

Figure 1:
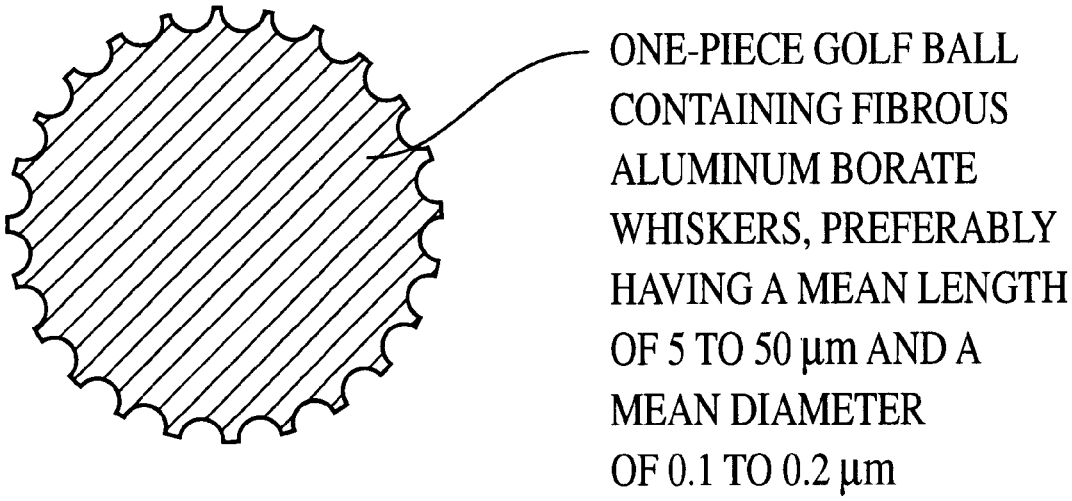
FIG. 1 is a cross-section of the golf ball in accordance with this invention.

The golf ball of the invention has a solid core formed of a core stock containing a thermoplastic resin or thermoplastic elastomer as a main component and may be constructed as a one, two, three or multi-piece golf ball. FIG. 1 illustrates a one-piece construction. More advantages are obtained when the solid core itself constitutes a golf ball, that is, one-piece golf ball.

The thermoplastic resin used as the main component of the core stock may be selected from well-known ones, preferably ionomer resins. Commercially available examples of the ionomer resin include Himilan 1605 (sodium ion neutralization type) and Himilan 1706 (zinc ion neutralization type) by Mitsui dupont Polychemical K.K. and Surlyn 8120 (sodium ion neutralization type) and Surlyn 7930 (lithium ion neutralization type) by E. I. duPont. These ionomer resins may be used alone or in admixture of two or more.

The thermoplastic elastomer used herein includes thermoplastic polyester elastomerse thermoplastic polyurethane elastomers, and thermoplastic polyamide elastomers. They are commercially available. Exemplary thermoplastic polyester elastomers are Hytrel 4047 and Hytrel 4767 by Toray duPont K.K.; an exemplary thermoplastic polyurethane elastomer is Pandex T7890 by Dai-Nihon Ink Chemical Industry K.K.; and an exemplary thermoplastic polyamide elastomer is Pabex 4033SN00 by Atochem of France. These elastomers may be used alone or in admixture of two or more. A mixture of a thermoplastic resin and a thermo-plastic elastomer is also useful.

To enhance the restitution and improve the durability in terms of cut resistance and scuff resistance of the core stock, according to the invention, fibrous aluminum borate whiskers are blended in the core stock. The fibrous aluminum borate whiskers are very fine (that is, a high aspect ratio) white needle crystals as compared with glass fibers, so that white coloring may be readily achievable. The whiskers are improved in coloring particularly when a one-piece golf ball is formed from the core stock. The whiskers have high strength and high tensile modulus. Additionally, the whiskers ensure uniform dispersion and uniform reinforcement. That is, the whiskers can be readily mixed with the thermoplastic resin or elastomer to form a uniform blend.

The fibrous aluminum borate whiskers are commercially available, for example, under the trade name of Alborex Y and Alborex T3A from Shikoku Chemicals K.K.

Although the shape of fibrous aluminum borate whiskers is not particularly limited, the preferred fibrous aluminum borate whiskers have a mean fiber length of 5 to 50 $\mu$m, especially 10 to 30 $\mu$m and a mean fiber diameter of 0.1 to 2 $\mu$m, especially 0.5 to 1 $\mu$m. Whiskers with a mean fiber length of less than 5 $\mu$m would sometimes fail to provide sufficient reinforcement with respect to the durability of scuff resistance. Whiskers with a mean fiber length of more than 50 μm would lack uniform dispersing and reinforcing abilities because of their rough fiber shape, failing to achieve sufficient reinforcement to provide durability. Whiskers with a mean fiber diameter of less than 0.1 μm are weak so that they may be broken upon kneading, failing to achieve reinforcement. Whiskers with a mean fiber diameter of more than 2 μm would lack uniform dispersing and reinforcing abilities because of their rough fiber shape, failing to achieve sufficient reinforcement to provide durability. It is noted that the mean fiber length and diameter are measured by microscopy.

Upon use, the fibrous aluminum borate whiskers are preferably surface treated with various surface treating agents to improve the miscibility thereof. Any of well-known surface treating methods may be used although surface treatment with silane coupling agents is preferred. Exemplary silane coupling agents include y-methacryloxypropyltrimethoxysilane, γ-aminopropyltriethoxysilane, and β-(3,4-epoxycyclohexyl)ethyltrimethoxysilane.

No particular limit is imposed on the amount of fibrous aluminum borate whiskers blended although an appropriate amount is 1 to 20 parts, especially 3 to 10 parts by weight per 100 parts by weight of the thermoplastic resin or elastomer Less than 1 part by weight of whiskers is too small to impart cut resistance and scuff resistance more than 20 parts by weight of whiskers can deteriorate resilience.

In the core stock, various additives such as coloring agents, lubricants and fillers may be blended in addition to the above-mentioned components, if desired and insofar as the objects of the invention are not impaired. Examples of the coloring agent include titanium oxide, barium sulfate, Prussian blue, red iron oxide, chrome yellow, and fluorescent coloring pigments. Examples of the lubricant include magnesium stearate, aluminum stearate, and calcium stearate. Examples of the filler include calcium carbonate, talc, and glass fibers. The core can be prepared by mixing properly selected ingredients in a conventional mixer, for example, closed kneading machines, single and twin screw extruders and molding the resulting core stock by well-known conventional techniques.

Where the solid core of the invention is used in two, three and multi-piece golf balls, the cover may be formed of any well-known cover stock. In this case, the diameter and weight of the solid core may be properly determined in accordance with conventional construction techniques.

Whether it is a one-piece golf ball or a two or multi-piece solid golf ball, the golf ball of the invention may be properly adjusted to a weight and diameter complying with the Rules of Golf. The manufacturing method is not critical and any of well-known techniques such as compression molding and injection molding may be used.

EXAMPLE

Examples of the invention are given below by way of illustration and not by way of limitation.

EXAMPLE 1–2 and COMPARATIVE EXAMPLES 1–3

One-piece solid golf balls were prepared by blending a thermoplastic elastomer with a filler fibrous aluminum borate whiskers, potassium titanate or glass fibers as shown in Table 1) as shown in Table 2, kneading them in a twin screw extruder, and injection molding the blend.

The golf balls were examined for restitution, durability in terms of cut and scuff resistances, and roundness after shots by the following methods.

Restitution

After the ball was kept at 23° C., an initial velocity (m/s) was measured using a meter as prescribed in USGA.

Durability

The ball was kept at 23° C. Using a swing robot of True Temper Co. and swinging a pitching wedge at a head speed of 37 m/sec., the ball was hit at three spots. The ball was observed to examine how the hit spots were damaged. The ball was rated on a five-point scale.

5: no change on the ball surface, or slight club face indents are left, but not so noticeable 4: club face indents are left, but the ball surface is not fluffy 3: the ball surface is fluffy and scuffed 2: the ball surface is fluffy and cracked 1: dimples are scraped Roundness after shots The ball was kept at 23° C. Using a swing robot of True Temper Co., the ball was hit ten times with a driver at a head speed of 45 m/sec. The ball was examined for roundness before and after the shots and rated according to the following criterion.

| Rating | Roundness difference before and after shots |
|---|---|
| ⊙ | less than 0.2 mm |
| ○ | 0.2 to 0.3 mm |
| X | more than 0.3 mm |

The results are shown in Table 2.

TABLE 1

| | Outer appearance/ shape | Mean fiber length (μm) | Mean fiber diameter (μm) | Mohs hardness | Tensile strength (kgf/mm) | Tensile modulus (tonf/mm$^2$) |
|---|---|---|---|---|---|---|
| Aluminum borate whiskers[1)] | white needle crystal | 10–30 | 0.5–1.0 | 7 | 900 | 40 |
| Potassium titanate[2)] | white needle crystal | 10–20 | 0.3–0.6 | 4 | 700 | 28 |

TABLE 1-continued

| | Outer appearance/ shape | Mean fiber length ($\mu$m) | Mean fiber diameter ($\mu$m) | Mohs hardness | Tensile strength (kgf/mm) | Tensile modulus (tonf/mm$^2$) |
|---|---|---|---|---|---|---|
| Glass fibers[3)] | — | 30–300 | 10 | — | — | — |

[1)]Aluminum borate whiskers: Alborex Y3A (surface treated with aminosilane coupling agent) by Shikoku Chemicals K.K.
[2)]Potassium titanate: Tismo-D by Otguska Chemical K.K.
[3)]Glass fibers: Milled Fiber by Asahi Fiber Glass K.K.

TABLE 2

| | E1 | E2 | CE1 | CE2 | CE3 |
|---|---|---|---|---|---|
| TPEE | 100 | 100 | 100 | 100 | 100 |
| Aluminum borate whiskers | 5 | 10 | — | — | — |
| Glass fibers | — | — | — | 10 | — |
| Potassium titanate | — | — | — | — | 10 |
| Initial velocity (m/s) | 74.3 | 74.0 | 75.4 | 73.5 | 73.7 |
| Durability | 5 | 5 | 2 | 4 | 4 |
| Roundness | ⊛ | ⊛ | X | ○ | ⊛ |

TPEE: Hytrel 4047 by Toray duPont K.K.

There has been described a golf ball including a solid core formed of a core stock of a thermoplastic resin or elastomer in admixture with fibrous aluminum borate whiskers. The ball is improved in restitution. Particularly when a one-piece golf ball is formed from the core stock, it has improved durability and high resistance to indentation upon iron shots, that is, improved cut and scuff resistance, and is left less deformed aster shots.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball comprising a solid core which is formed of a core stock comprising a thermoplastic resin or elastomer and fibrous aluminum borate whiskers.

2. The golf ball of claim 1 wherein the fibrous aluminum borate whiskers have a mean fiber length of 5 to 50 $\mu$m and a mean fiber diameter of 0.1 to 2 $\mu$m.

3. The golf ball of claim 1 wherein the fibrous aluminum borate whiskers have been surface treated with a silane coupling agent.

4. The golf ball of claim 1 wherein the core stock contains 100 parts by weight of the thermoplastic resin or elastomer and 1 to 20 parts by weight of the fibrous aluminum borate whiskers.

5. The golf ball of claim 1 wherein the thermoplastic resin or elastomer is an ionomer zesin, thermoplastic polyester elastomer, thermoplastic polyurethane elastomer or thermoplastic polyamide elastomer.

6. The golf ball of claim 1 which is a one-piece solid golf ball.

* * * * *